US011439551B2

(12) United States Patent
Davis

(10) Patent No.: US 11,439,551 B2
(45) Date of Patent: Sep. 13, 2022

(54) LATERAL TRANSFER MATTRESS AND ROTATIONAL POSITIONING DEVICE

(71) Applicant: D.T. DAVIS ENTERPRISES, LTD., Allentown, PA (US)

(72) Inventor: David T. Davis, Bethlehem, PA (US)

(73) Assignee: D.T. Davis Enterprises, Ltd., Allentown, PA (US)

( * ) Notice: Subject to any disclaimer, the term of this patent is extended or adjusted under 35 U.S.C. 154(b) by 75 days.

(21) Appl. No.: 16/739,782

(22) Filed: Jan. 10, 2020

(65) Prior Publication Data

US 2020/0146913 A1 May 14, 2020

Related U.S. Application Data

(63) Continuation of application No. 16/738,083, filed on Jan. 9, 2020, which is a continuation of application No. PCT/US2018/046051, filed on Aug. 9, 2018.

(60) Provisional application No. 62/545,043, filed on Aug. 14, 2017, provisional application No. 62/544,394, filed on Aug. 11, 2017, provisional application No.
(Continued)

(51) Int. Cl.

| | |
|---|---|
| ***A61G 7/10*** | (2006.01) |
| ***A61G 7/00*** | (2006.01) |
| ***A61G 7/057*** | (2006.01) |

(52) U.S. Cl.

CPC ..... *A61G 7/1028* (2013.01); *A61G 7/001* (2013.01); *A61G 7/05776* (2013.01); *A61G 7/1021* (2013.01); *A61G 2200/32* (2013.01)

(58) Field of Classification Search

CPC .. A61G 7/1028; A61G 7/001; A61G 7/05776; A61G 7/1021; A61G 2200/32; A47C 27/08

See application file for complete search history.

(56) References Cited

U.S. PATENT DOCUMENTS

| | | | |
|---|---|---|---|
| 3,654,059 | A | 4/1972 | Zisblatt |
| 5,067,189 | A | 11/1991 | Weedling et al. |
| 6,073,291 | A | 6/2000 | Davis |

(Continued)

FOREIGN PATENT DOCUMENTS

| | | | |
|---|---|---|---|
| EP | 1985273 | A2 | 10/2008 |
| WO | 2013166003 | A1 | 11/2013 |

OTHER PUBLICATIONS

European Patent Office, Partial Supplementary European Search Report, corresponding European Patent Application No. 18844096.0, dated Apr. 7, 2021.

(Continued)

*Primary Examiner* — Peter M. Cuomo
*Assistant Examiner* — Adam C Ortiz
(74) *Attorney, Agent, or Firm* — Duane Morris LLP

(57) ABSTRACT

An inflatable transfer mattress includes a top panel, a bottom panel having a perimeter sealingly coupled to a perimeter of the top panel to define an internal volume therebetween, and a rotational positioning device coupled to the top panel. The internal volume is configured to receive an air flow therein. The rotational positioning device is positioned outside of the internal volume and includes at least one inflatable bladder configured to be inflated from a deflated state to an inflated state. The bladder portion is configured to rotate a patient to a predetermined angle with respect to the top panel in the inflated state.

19 Claims, 22 Drawing Sheets

Related U.S. Application Data

62/544,412, filed on Aug. 11, 2017, provisional application No. 62/544,340, filed on Aug. 11, 2017.

(56) References Cited

U.S. PATENT DOCUMENTS

| | | | | |
|---|---|---|---|---|
| 2002/0133877 | A1 | 9/2002 | Kuiper et al. | |
| 2005/0193496 | A1 | 9/2005 | Weedling et al. | |
| 2007/0143928 | A1* | 6/2007 | Biggie ..... | A61G 7/0525 5/715 |
| 2015/0128341 | A1 | 5/2015 | Kuiper et al. | |
| 2016/0324707 | A1* | 11/2016 | Lachenbruch ..... | A47C 27/083 |

OTHER PUBLICATIONS

International Search Report and Written Opinion issued in connection with corresponding International Patent Application No. PCT/2018/046051; dated Dec. 12, 2018.

European Patent Office, Extended European Search Report dated Sep. 2, 2021, in corresponding European Patent Application No. 18844096.0.

* cited by examiner

LATERAL TRANSFER MATTRESS AND ROTATIONAL POSITIONING DEVICE

CROSS-REFERENCE TO RELATED APPLICATIONS

This application is a U.S. Continuation application of Ser. No. 16/738,083; filed Jan. 9, 2020; which claims the benefit of International Application No. PCT/US2018/046051; filed Aug. 9, 2018, which claims the benefit of U.S. Provisional Application Ser. No. 62/544,340, filed Aug. 11, 2017, entitled "NON-WOVEN BLADDERS DESIGN OF A LATERAL TRANSFER AND ROTATIONAL POSITIONING DEVICE," U.S. Provisional Application Ser. No. 62/544,394, filed Aug. 11, 2017, entitled "LATERAL TRANSFER MATTRESS AND ROTATIONAL POSITIONING DEVICE," U.S. Provisional Application Ser. No. 62/544,412, filed Aug. 11, 2017, entitled "FOUR LAYER LATERAL TRANSFER MATTRESS AND ROTATIONAL POSITIONING DEVICE," and U.S. Provisional Application Ser. No. 62/545,043, filed Aug. 14, 2017, entitled "PONTOON LONGITUDINAL STRINGERS FOR LATERAL TRANSFERRING AND LOG ROLLING," each of which is incorporated by reference herein in its respective entirety.

BACKGROUND

Immobility and prolonged confinement present both psychological and physically evident pathological problems to patients, ranging from malaise, depression, feelings of helplessness and loss of motivation on the one hand to decubitus ulcers, loss of local circulation and unsanitary dermatologic insult from waste products, or edema of extremities and gangrene on the other. Not only are patients affected by these conditions but so too are the caregivers and clinicians who must lift, turn, wash, change bedding and clothes, arrange for food, treat, and dispose of waste. Such operations often require that attendants have a high level of strength and skill to move and reposition the patient, regardless of the patient's size or weight.

Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet. Current patient handling mattresses provide support for patients, but do not provide rotational or turning support.

SUMMARY

In various embodiments, an inflatable transfer mattress is disclosed. The inflatable transfer mattress includes a top panel, a bottom panel having a perimeter sealingly coupled to a perimeter of the top panel to define an internal volume therebetween, and a rotational positioning device coupled to the top panel. The internal volume is configured to receive an air flow therein. The rotational positioning device is positioned outside of the internal volume and includes at least one inflatable bladder configured to be inflated from a deflated state to an inflated state. The bladder portion is configured to rotate a patient to a predetermined angle with respect to the top panel in the inflated state.

In various embodiments, an inflatable transfer mattress is disclosed. The inflatable transfer mattress includes a top panel, a bottom panel having a perimeter sealingly coupled to a perimeter of the top panel to define an internal volume therebetween, a plurality of stringers positioned within the internal volume, and an inflatable bladder coupled to the top panel. The internal volume is configured to receive an air flow therein. Each of the plurality of stringers includes a first edge coupled to the top panel and a second edge coupled to the bottom panel. The inflatable bladder positioned outside of the internal volume, wherein the inflatable bladder defines a first bladder portion and a second bladder portion each configured to be independently inflated to define a predetermined angle with respect to the top panel.

In various embodiments, a method of positioning a patient is disclosed. The method includes a step of positioning an inflatable transfer mattress on a first surface. The inflatable transfer mattress includes a top panel, a bottom panel having a perimeter sealingly coupled to a perimeter of the top panel to define an internal volume therebetween, and an inflatable bladder coupled to the top panel of the inflatable transfer mattress and positioned outside of the internal volume. The inflatable bladder defines a first bladder portion and a second bladder portion each configured to be independently inflated to define a predetermined angle with respect to the top panel. A patient is positioned on the inflatable transfer mattress and the first bladder portion is inflated to rotate the patient to a first predetermined rotational angle with respect to the top panel of the inflatable transfer mattress. The first bladder portion is inflated by an air supply coupled to a valve formed integrally with the first bladder portion.

In various embodiments, an inflatable transfer mattress is disclosed. The inflatable transfer mattress includes a top panel, a bottom panel having a perimeter sealingly coupled to a perimeter of the top panel to define an internal volume therebetween, and a plurality of inflatable pontoons positioned within the internal volume. The internal volume is configured to receive an air flow therein. Each of the plurality of inflatable pontoons is configured to be transitioned from a deflated state in which each of the plurality of inflatable pontoons are flat to an inflated state in which each of the plurality of inflatable pontoons define a cylindrical cross-section.

In various embodiments, an inflatable transfer mattress is disclosed. The inflatable transfer mattress includes a top panel, a bottom panel having a perimeter sealingly coupled to a perimeter of the top panel to define an internal volume therebetween, and a plurality of inflatable pontoons positioned within the internal volume. The internal volume is configured to receive an air flow therein. Each of the plurality of inflatable pontoons is configured to be transitioned from a deflated state in which each of the plurality of inflatable pontoons are flat to an inflated state in which each of the plurality of inflatable pontoons define a cylindrical cross-section. Each of the plurality of inflatable pontoons is coupled to the top panel along a first line and the bottom panel along a second line and coupled to an adjacent one of the plurality inflatable pontoons.

In various embodiments, a method is disclosed. The method includes the step of positioning an inflatable transfer mattress on a first surface. The inflatable transfer mattress includes a top panel, a bottom panel having a perimeter sealingly coupled to a perimeter of the top panel to define an internal volume therebetween, and a plurality of inflatable pontoons positioned within the internal volume. Each of the plurality of inflatable pontoons is configured to be transitioned from a deflated state in which each of the plurality of inflatable pontoons are flat to an inflated state in which each of the plurality of inflatable pontoons define a cylindrical cross-section. A patient is positioned on the inflatable transfer mattress and a first set of the plurality of inflatable pontoons is inflated to rotate the patient to a first predetermined rotational angle with respect to the top panel of the inflatable transfer mattress. The first set of the plurality of inflatable pontoons is inflated by an air supply coupled to a valve formed integrally with an air flow path of the first set of the plurality of inflatable pontoons.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
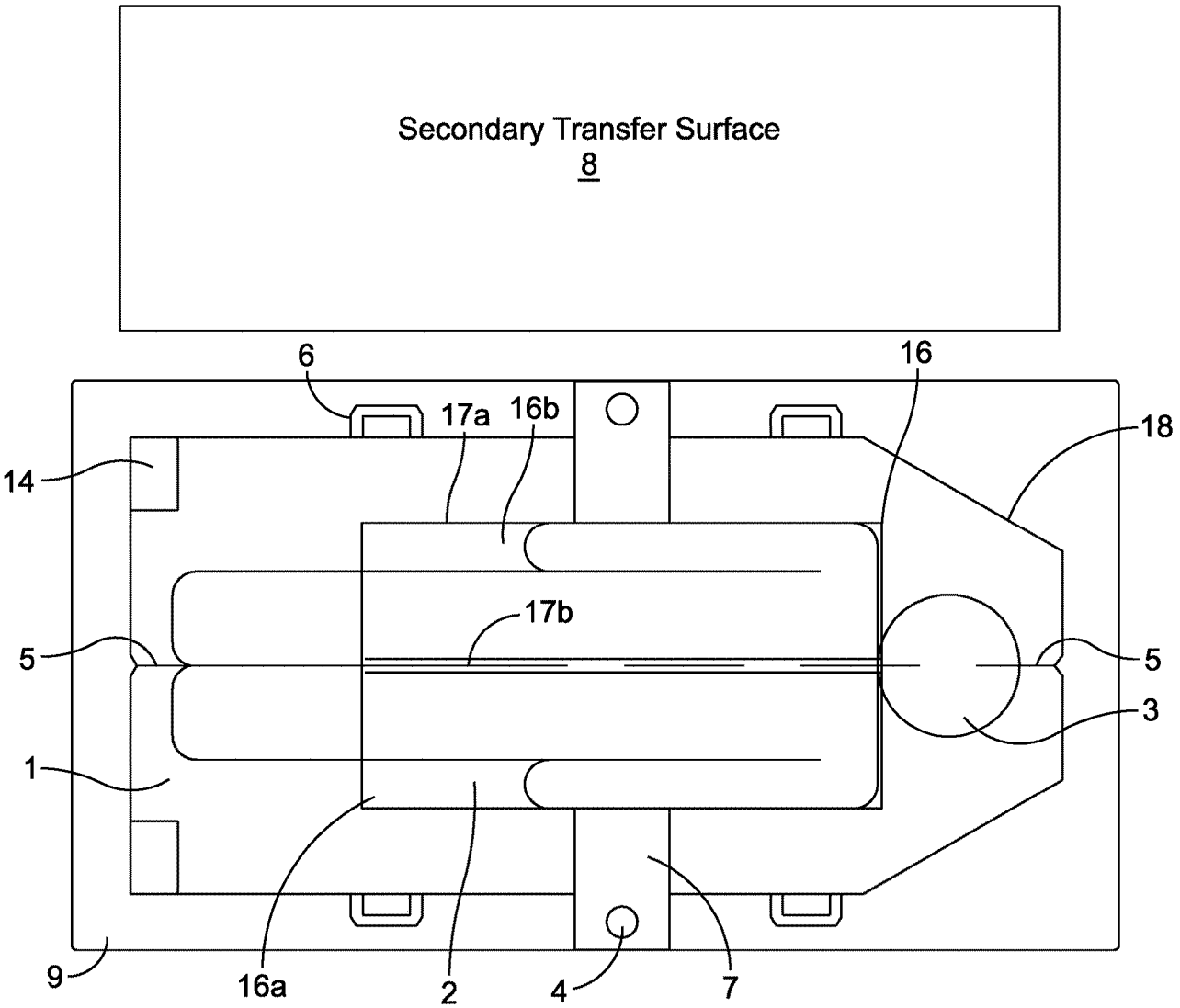
FIG. 1 illustrates a top view of a patient transfer device including one or more bladders and having a patient thereon, in accordance with some embodiments.

The description of the preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In this description, relative terms such as "horizontal," "vertical," "up," "down," "top," "bottom," as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both moveable or rigid attachments or relationships, unless expressly described otherwise. The term "operatively coupled" is such an attachment, coupling, or connection that allows the pertinent structures to operate as intended by virtue of that relationship. In the claims, means-plus-function clauses, if used, are intended to cover structures described, suggested, or rendered obvious by the written description or drawings for performing the recited function, including not only structure equivalents but also equivalent structures.

Figure 2:
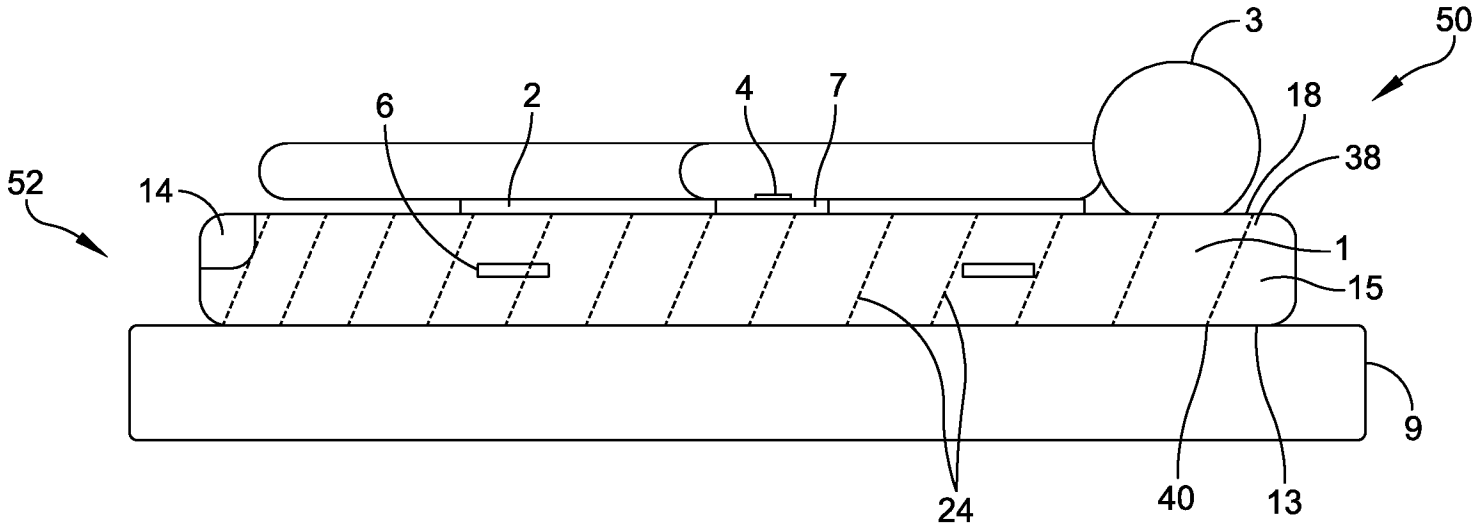
FIG. 2 illustrates a side view of the patient transfer device of FIG. 1, in accordance with some embodiments.
Figure 3:
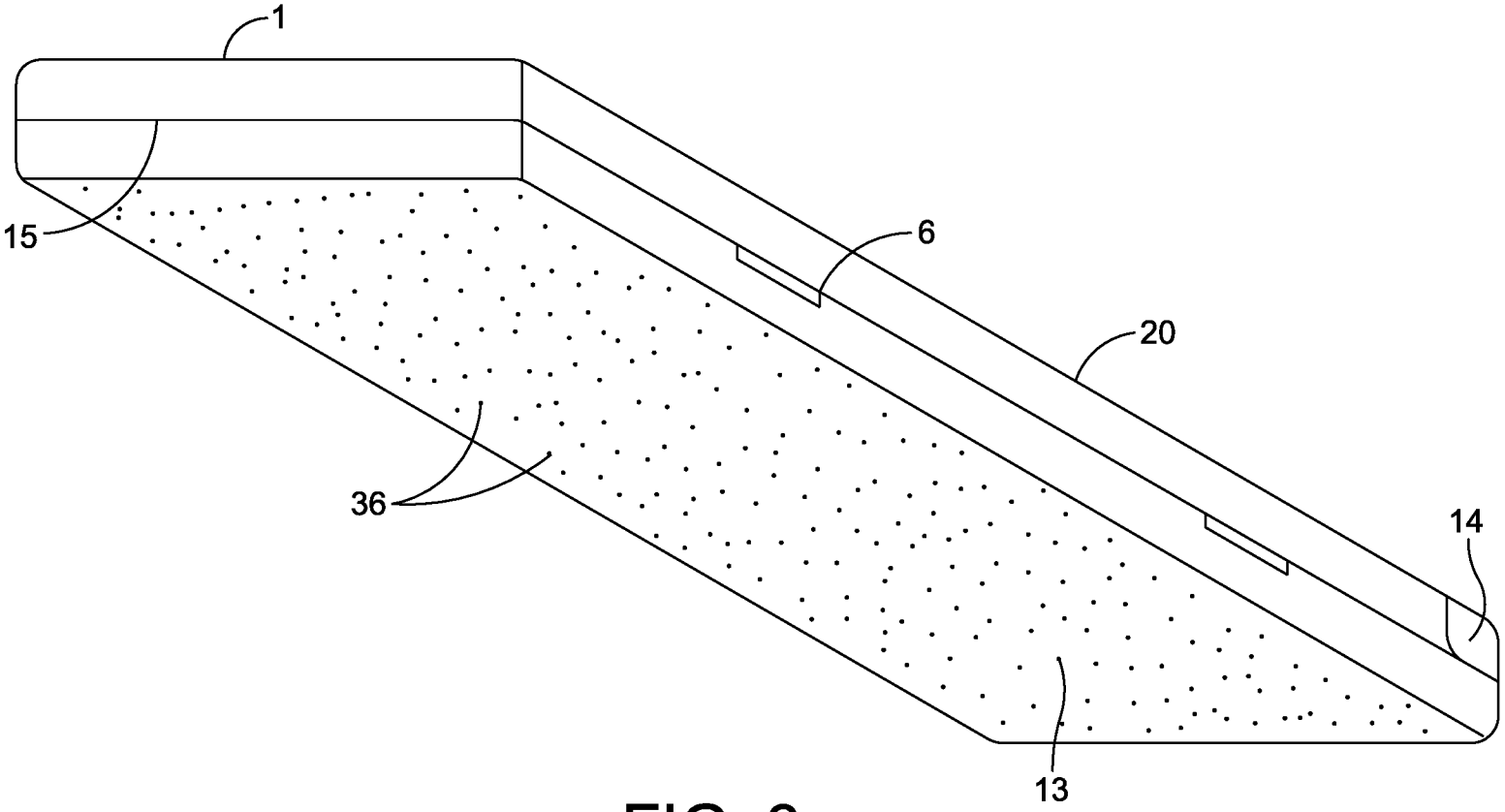
FIG. 3 illustrates a bottom perspective view of the patient transfer device of FIG. 1, in accordance with some embodiments.

FIGS. 1-6 illustrate an inflatable transfer mattress 1 having a rotational positioning device 2 formed integrally therewith, in accordance with some embodiments. The inflatable transfer mattress 1 includes a top panel 18, a bottom panel 13, and a plurality of stringers 24 positioned between the top panel 18 and the bottom panel 13, as shown in FIG. 2. The inflatable transfer mattress 1 includes a proximal (or head) portion 50 and a distal (or foot) portion 52. The top panel 18 includes a head portion, a foot portion, and a peripheral edge. Likewise, the bottom panel 13 includes a head portion, a foot portion, and a peripheral edge, and is substantially similar in peripheral profile to top panel 18. In the illustrated embodiment, the peripheral edge of the top panel 18 is sealingly fastened to the peripheral edge of the bottom panel 13 to define an internal volume between the top panel 18 and the bottom panel 13. In some embodiments, a perimeter band (not shown) is coupled between the top panel 18 and the bottom panel 13. The perimeter band can include an elongate substantially rectangular strip, having a top edge and a bottom edge. In some embodiments, the perimeter 15 of the inflatable transfer mattress 1 is defined by a weld between the top panel 18 and the bottom panel 13.

An inlet opening 14 is formed in a portion of the top panel 18 and/or the bottom panel 13. The inlet opening is configured to receive an air hose or other air supply and transfer an air flow from the supply to the internal volume defined between the top panel 18 and the bottom panel 13. In some embodiments, the inlet opening 14 is a closeable opening that sealingly accepts an air supply hose. The inlet opening 14 is sized and shaped so that the air supply hose may be inserted, with the inlet 14 being thereafter snapped shut or otherwise closed to hold the air supply hose in place while inflatable transfer mattress 1 is being inflated. The inlet opening 14 may include a valve that is biased to be normally closed to prevent air from exiting the inlet 14 and opened when the air supply hose is inserted into inlet opening 14. Other arrangements known to those skilled in the art may be used to inflate inflatable transfer mattress 1. In embodiments including a perimeter band, features identified as being formed on the top panel 18 and/or the bottom panel 13, such as, for example, the inlet opening 14, may be located on the perimeter band. It will be recognized that any embodiment described herein may include a perimeter band and is within the scope of this disclosure and the claims.

The bottom panel 13 includes a plurality of holes 36 that are defined through the bottom panel's 13 thickness to allow air to escape in a controlled (e.g., predetermined) manner so as to allow inflatable transfer mattress 1 to be used as a transfer mattress. The air supplied to a transfer-capable embodiment of inflatable transfer mattress 1 (i.e., air transferred into the internal volume through inlet 14) escapes through the plurality of holes 36, providing a weight-bearing cushion of air which functions as a lubricant to reduce friction and facilitate the sliding of inflatable transfer mattress 1 along a surface 9, as well as, from a first surface 9 to a secondary transfer surface 8. The first surface 9 and/or the second surface 8 can include one or more of bed, stretcher, operating tables, imaging tables, and/or any other suitable surface.

The plurality of stringers 24 each comprise substantially rectangular sheets of nylon scrim or the like, and include a top edge 38 and a bottom edge 40. Stringers 24 may have differing or varying widths, depending upon their position within inflatable transfer mattress 1. Each top edge 38 may be fastened longitudinally or transversely to a portion of the inner surface of top panel 18, and each bottom edge 40 may be fastened longitudinally or transversely to a portion of the inner surface of bottom panel 13. When stringers 24 are assembled in a transverse manner, they can have a narrow center section that causes at least top panel 18 to form a longitudinally oriented concave recess which helps to cradle a patient's legs when inflatable transfer mattress 1 is inflated with air. A similar concave recess is formed when stringers 24 are assembled in a longitudinal manner.

In some embodiments, the inflatable transfer mattress 1 includes one or more handles 6 configured to facilitate movement of the inflatable transfer mattress 1 from the first surface 9 to the secondary transfer surface 8. Each of the handles 6 are positioned along a peripheral edge 15 of the inflatable transfer mattress 1. The handles 6 can include any suitable woven and/or non-woven material coupled to the inflatable transfer mattress 1 and configured to sustain a predetermined force to allow sliding of the inflatable transfer mattress 1. In some embodiments, the handles 6 can be omitted and straps, eyelets, and/or other devices can be configured to allow handles or other transfer mechanism to be attached to and/or detached from the inflatable transfer mattress 1.

In some embodiments, the inflatable transfer mattress 1 includes a rotational positioning device 2 coupled to and/or formed integrally therewith. In the illustrated embodiment, the rotational positioning device 2 includes one or more bladders 16 coupled to the top panel 18 of the inflatable transfer mattress 1. Each of the inflatable bladders 16 includes a top bladder surface 22 and a bottom bladder surface 21 sealingly coupled (e.g., welded 17*a*) together to define an internal volume therebetween.

In some embodiments, the inflatable bladder 16 includes a center weld 17*b* formed along a centerline 5 of the inflatable bladder 16 and/or the inflatable transfer mattress 1. The center weld 17*b* separates the inflatable bladder 16 into a first inflatable bladder portion 16*a* and a second inflatable bladder portion 16*b*. Each of the inflatable bladder portions 16*a*, 16*b* define independent internal volumes configured to receive air flow from an air source, as described in greater detail below. Although embodiments are discussed herein including a single inflatable bladder 16 including a center weld 17*b*, it will be appreciated that the inflatable bladder portions 16*a*, 16*b* can be defined independent bladders that are formed separately and independently coupled to the top panel. In some embodiments, the inflatable bladder 16 can include a plurality of welds (not shown) each separating the inflatable bladder into multiple independently and/or joint inflatable portions. In some embodiments, the stringers 24 are positioned and/or attached to ensure that the inflatable bladder 16 is air tight when the inflatable transfer mattress 1 and/or the inflatable bladder portions 16*a*, 16*b* are inflated.

In some embodiments, the inflatable bladder 16 includes a plurality of inlets 4 sized and configured to receive an air supply hose from an air supply source (not shown). Each of the inlets 4 are similar to the inlet 14 described above, and similar description is not repeated herein. In embodiments including multiple inflatable bladder portions 16*a*, 16*b*, each the bladder portions 16*a*, 16*b* includes an inlet 4 configured to provide air inflow and/or outflow from an associated inflatable bladder portion 16*a*, 16*b*. For example, in the illustrated embodiment, the inflatable bladder 16 includes a center weld 17*a* that defines a first bladder portion 16*a* and a second bladder portion 16*b*. The first bladder portion 16*a* includes a first inlet 4*a* formed integrally therewith and the second bladder portion 16*b* includes a second inlet 4*b* formed integrally therewith. It will be appreciated that the bladder 16 can include any number of air inlets 4 corresponding to any number of bladder portions 16*a*, 16*b* defined by the welds 17.

Figure 4:
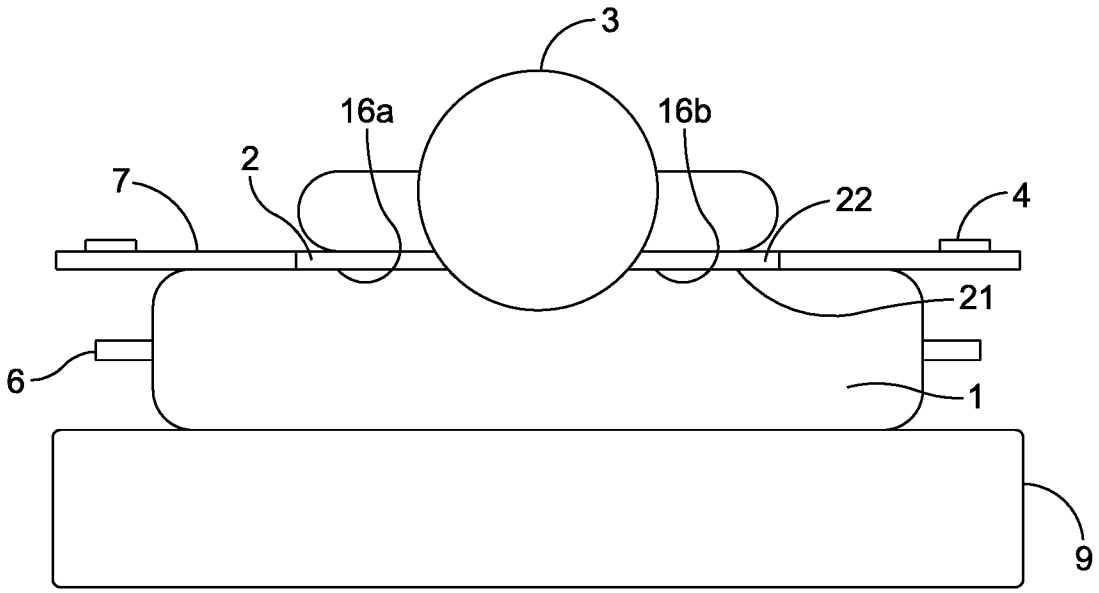
FIG. 4 illustrates a front view of the patient transfer device of FIG. 1, in accordance with some embodiments.

In some embodiments, each of the inflatable bladder portions 16*a*, 16*b* includes an air flow path 7 defining an extension of the inflatable bladder 16 that extends beyond the perimeter 15 of the inflatable transfer mattress 7. In some embodiments, the air inlet 4 for the associated inflatable bladder portion 16*a*, 16*b* is disposed at a terminal (or free) end of the air inlet path 7 such that the air inlet 4 is positioned outside of an area occupied by a patient when the patient is positioned on the inflatable transfer mattress 1 and rotational positioning device 2, for example, as illustrated in FIG. 4. The air inlet 4 and the air inlet path 7 allow the associated bladder portion 16*a*, 16*b* to be inflated without needing to disturb and/or move a patient positioned on the inflatable transfer mattress 1. In some embodiments, the air flow rate from the air supply is sufficient to overcome a force applied by a patient such that the inflatable bladder portion 16*a*, 16*b* can be inflated despite the weight/force of a patient on the respective inflatable bladder portion 16*a*, 16*b*.

In some embodiments, the top bladder surface 22 and/or the top panel 18 can be formed of (or include an integral layer of) suitable patient contact material. For example, in various embodiments, the top bladder surface 22 of the bladder 16, the top panel 18, and/or any other portion of the inflatable transfer mattress 1 may be formed from a sheet of fabric, e.g., nylon scrim or the like, and may be coated on at least an outer surface with a water proof coating. The water proof coating may be any of the well-known polymeric or elastomeric compounds that are known to be impervious to semi-solids and liquids, such as, blood, urine, feces, hospital strength disinfecting compounds, alcohol, or the like. For example, a nylon twill fabric may be coated on one side with a heat sealable, polyurethane coating (e.g., an inner side) and the outer side coated with a Durable Water Repellent (patient side). A practical benefit associated with the use of the foregoing materials is that inflatable transfer mattress 1 retains a better appearance for longer periods of time during use. A double coated inflatable transfer mattress 1 can be easily wiped down, and can be put back into use more quickly.

Alternatively, in those instances where a single use, single patient mattress is provided, i.e., where patient use lasting less than twenty four hours is desired, the top bladder surface 22 of the bladder 16, the top panel 18, and/or any other portion of the inflatable transfer mattress 1 may be formed from fibers/fabrics suitable for a single use panel, such as, for example, acetate, acrylic, anidex, aramid, azion, cotton, elastomer, fluorocarbon, fur, glass, lyocell, melamine, metallic, modacrylic, modal, mosacrylic, novoloid, nylon, nytril, olefin, PAN, PBI, PEEK, Pelco, PEN, PLA, PTT, polyester, polyester-polyarylate, rayon, saran, spandex, sulfar, triacetate, vinal, vinyon, and wool. A common characteristic of the foregoing and like materials is their propensity to stain or discolor as a result of contact with blood, urine, feces, hospital strength disinfecting compounds, alcohol, or the like. Additional, a variety of films may be used to form a single patient, single use transfer mattress 1, for example, copolyester, copolyether, ethylene, vinyl acetate, fluorocarbon, polyamide, olefins, polybutylene, polycarbonate, polyester, polystyrene, polyurethane, polyvinyl, alcohol, polyvinyl chloride, polyvinyl fluoride, and plyvinylidene chloride. A practical benefit associated with the use of the foregoing materials is that transfer mattress 1 retains a stained or discolored appearance for longer periods of time after use thereby alerting hospital staff or other care givers that a particular transfer mattress 1 has completed its useful life, and must be discarded.

In one embodiment, the top bladder surface 22 of the bladder 16, the top panel 18, and/or any other portion of the inflatable transfer mattress 1 may comprise a cold water soluble partially hydrolyzed polyvinyl alcohol, cold water insoluble hot water disintegrable aliphatic polyester, and minor proportions of processing and performance aids. The aliphatic polyester has a melt temperature above the normal body temperature of a human (37 Degree C.; 98.6 degrees F.) and is present in the resin blend at a concentration sufficient to constitute the continuous phase of the blend. The aliphatic polyester renders the resin blend, and the partially hydrolyzed polyvinyl alcohol in the blend is cold water insoluble and determines the temperature at which articles formed from the blend will be subject to dissolution in an aqueous bath and subsequent disposal. A practical benefit associated with the use of the foregoing material is that transfer mattress 1 not only retains a stained and discolored appearance for longer periods of time after use, thereby alerting hospital staff or other care givers that a particular transfer mattress 1 has completed its useful life, and must be discarded, but also if an attempt is made to launder the mattress after a single use it disintegrates during the washing process.

Additional embodiments of inflatable transfer mattresses are disclosed in U.S. Pat. No. 7,266,852, issued Sep. 11, 2007, entitled "Inflatable Transfer Mattress," U.S. Pat. No. 7,186,723, issued Aug. 5, 2008, entitled "Inflatable Mattress and Method for Positioning a Patient," and U.S. Pat. No. 8,387,177, issued Mar. 5, 2013, entitled "Partially Deflatable Transfer Mattress and Method for Transporting a Patient in Comfort," and U.S. Patent App. Pub. No. 2008/0104762, published May 8, 2008, entitled "Transfer Mattress with Device Portal," each of which is incorporated herein by reference it their entireties.

Figure 5:
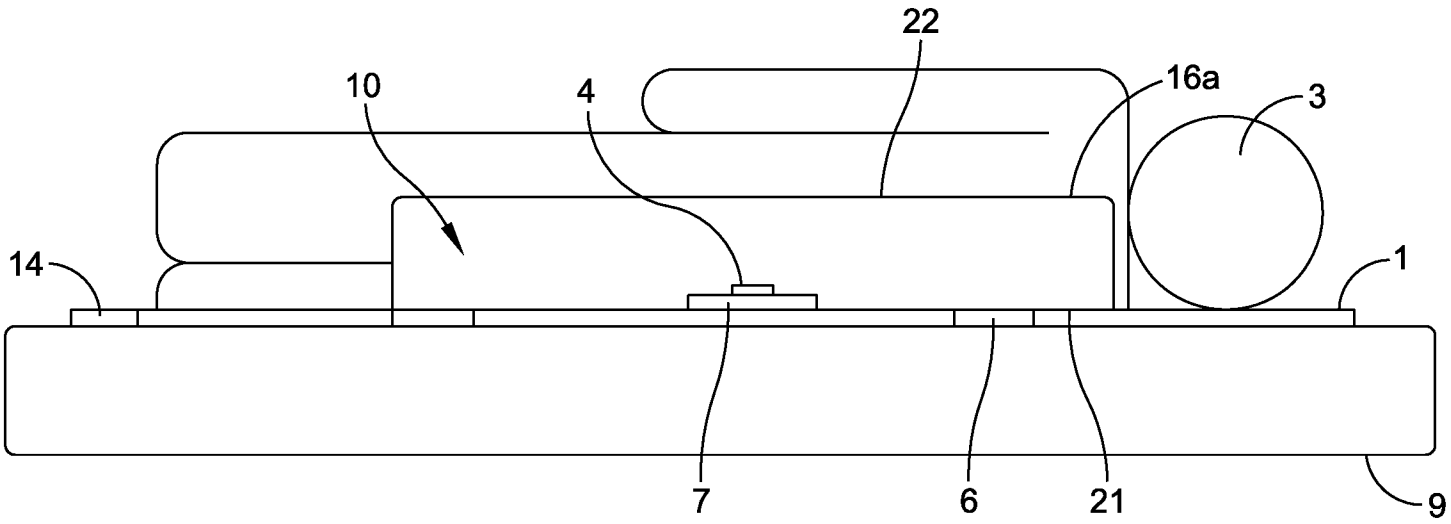
FIG. 5 illustrates a side view of the patient transfer device of FIG. 1 having a first bladder portion in an inflated state, in accordance with some embodiments.
Figure 6:
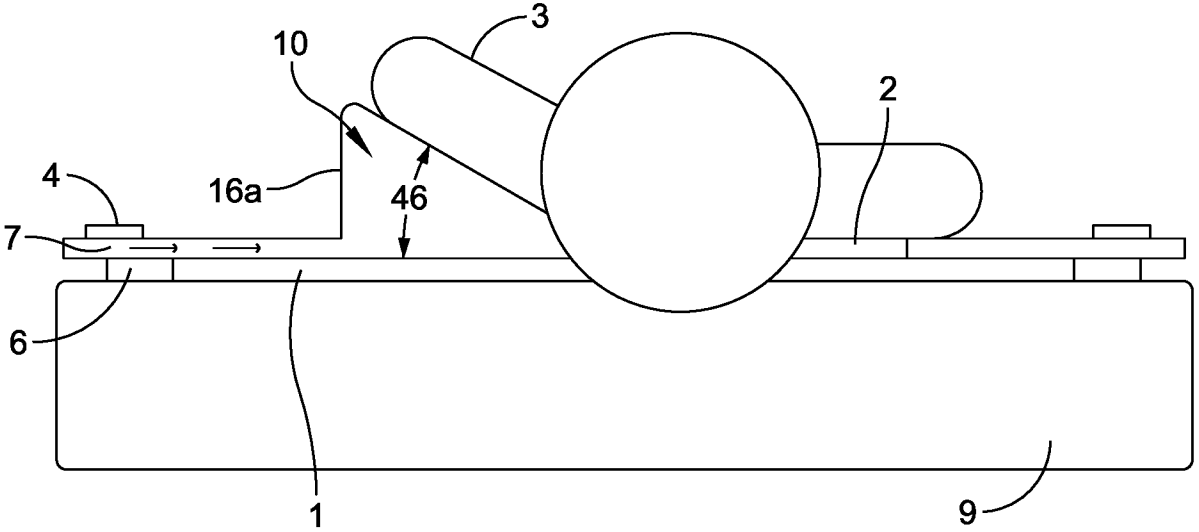
FIG. 6 illustrates a front view of the patient transfer device of FIG. 1 having the first bladder portion in an inflated state, in accordance with some embodiments.

With reference to FIGS. 4-5, in operation, the inflatable transfer mattress 1 is positioned on a first surface 9 prior to a patient 3 is positioned on a first surface 9 such that the inflatable transfer mattress 1 is positioned between the patient 3 and the first surface 9. The patient 3 is positioned in contact with the non-woven contact patient layer 20 (if present) and/or the upper surface 22 of the rotational bladder 16 and the top layer 18 of the inflatable transfer mattress 1. The inflatable transfer mattress 1 is maintained in a deflated state beneath the patient 3 until a transfer is required.

In some embodiments, the inflatable transfer mattress 1 is inflated to facilitate transfer of the patient 3 from the first surface 9 to a second surface 8. To transfer a patient 3 from the first surface 9 to the second surface 8, an air supply hose of an air supply (not shown) is coupled to the air inlet 14 in fluid communication with the internal volume between the top layer 18 and the bottom layer 13 of the inflatable transfer mattress 1. The air supply provides an air inflow into the internal volume which inflates the inflatable transfer mattress 1. A portion of the air flow is pushed through the plurality of holes 36 in the bottom layer 13 such that an air lubrication layer is generated between the first surface 9 and the inflatable transfer mattress 1. The air flow is maintained by the air supply throughout the transfer procedure to maintain a constant lubrication layer beneath the inflatable transfer mattress 1. The handles 6 of the inflatable transfer mattress 1 to apply a pushing and/or pulling force to transfer the inflatable transfer mattress 1 and the patient 3 between the first surface 9 and the second surface 8. The deflated rotational positioning device 2 remains in a deflated and lays flat under the patient during transfer.

In some embodiments, one or more of the inflatable bladder portions 16*a*, 16*b* are inflated to rotate a patient 3 to a predetermined rotational angle 46. To rotate a patient 3, an air supply hose from an air supply (not shown) is coupled to an air inlet 4 corresponding to the inflatable bladder portion 16*a*, 16*b* selected for inflation. The air supply provides an air inflow into the internal volume 10 defined by the selected inflatable bladder portion 16*a*, 16*b*. The air inflow inflates the inflatable bladder portion 16*a*, 16*b*. Inflation of the selected inflatable bladder portion 16*a*, 16*b* raises a portion of the patient 3 positioned in contact with and/or in-line with the selected inflatable bladder portion 16*a*, 16*b*. The patient 3 is rotated by the inflating bladder portion 16*a*, 16*b*. Rotation of a patient 3 relieves pressure on various portions of the patient's body and prevents bed sores or other issues caused by prolong contact with a surface. For example, in some embodiments, rotation of the patient 3 offloads the sacrum. In some embodiments, each of the inflatable bladder portions 16*a*, 16*b* can be inflated and/or deflated at regular intervals to alleviate pressure on various portions of the patient 3.

The patient 3 can be rotated to any rotational angle 46 up to a maximum rotational angle 46 defined at a maximum inflation of the inflatable bladder portion 16*a*, 16*b*. In various embodiments, each of the inflatable bladder portions 16*a*, 16*b* can be inflated to rotate a patient 3 to a rotational angle 46 in the range of 0–30°, 0-15°, 0-45°, and/or any other suitable range of angles. After a predetermined time period, the inflated inflatable bladder portion 16*a* may be deflated, for example, through valve 4 and/or through a deflation valve (not shown) coupled to the inflatable bladder portion 16*a*. In some embodiments, the weight of a patient 3 on the inflatable bladder portion 16*a* assists in deflation of the inflatable bladder portions 16*a*.

Figure 7:
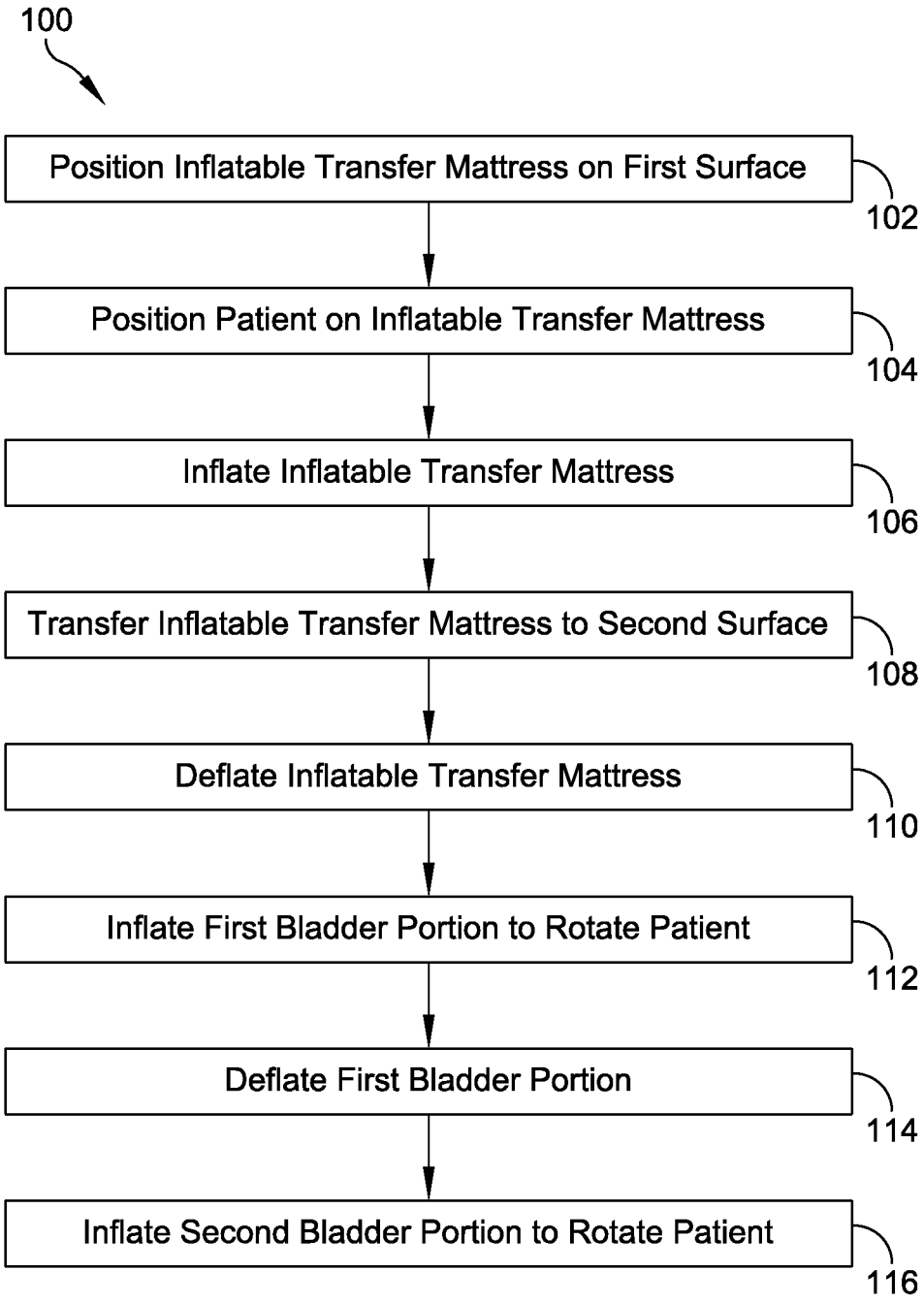
FIG. 7 illustrates a method of positioning and rotating a patient using an inflatable transfer mattress having a rotational positioning device formed integrally therewith, in accordance with some embodiments.

FIG. 7 illustrates a method 100 of positioning and rotating a patient 3 using an inflatable transfer mattress 1, in accordance with some embodiments. At step 102, an inflatable transfer mattress 1 is positioned on a first surface 9. The inflatable transfer mattress 1 is positioned such that a bottom layer 13 defining a plurality of holes 36 is in contact with the first surface 9. The inflatable transfer mattress 1 includes a rotational positioning device 2 formed integrally therewith. The first surface 9 can include any suitable surface, such as a bed, gurney, surgery table, imaging table, etc.

At step 104, a patient 3 is positioned on the inflatable transfer mattress 1. At step 106, the inflatable transfer mattress 1 is inflated by coupling an inflation device (e.g., an air source) to an inlet 14 in fluid communication with an internal volume defined between the bottom layer 13 and a top layer 18. The air flow from the inflation device is maintained during at least subsequent step 108 of the method 100.

At step 108, the inflatable transfer mattress 1 and the patient 3 are transferred from the first surface 9 to a second surface 8. The second surface can include any suitable surface, such as a bed, gurney, surgery table, imaging table, etc. Air flows from the internal volume defined between the bottom layer 13 and the top layer 18 through the plurality of holes 36 formed in the bottom layer 13. The air flow through the plurality of holes 36 provides an air lubrication layer between the inflatable transfer mattress 1 and the first and second surfaces 8, 9.

At step 110, the air flow from the inflation device is stopped and the inflatable transfer mattress 1 deflates. Deflation may occur due to air flow through the plurality of holes 36 and/or through a deflation valve (not shown). The rate of deflation caused by air flow through the plurality of holes 36 prevents injury to the patient 3 during deflation.

At step 112, a first inflatable bladder portion 16*a* of a rotational positioning device 2 is inflated to rotate a first portion of the patient 3 to a predetermined rotational angle 46. The inflatable bladder portion 16*a* is inflated by coupling an air supply hose of an inflation device to an inlet 4 coupled to an air flow path 7 of the inflatable bladder portion 16*a*. Air flow is provided to the internal cavity 10 defined by the inflatable bladder portion 16*a*, which inflates the inflatable bladder portion 16*a* to the predetermined rotational angle 46. Inflation of the inflatable bladder portion 16*a* rotates the patient 3 (or the first portion of the patient 3) to the predetermined rotational angle 46.

At step 114, the first inflatable bladder portion 16*a* is deflated and the patient 3 returns to a rotational angle of zero with respect to the inflatable transfer mattress 1. The inflatable bladder portion 16*a* can be deflated by valve 4 and/or a dedicated deflation valve (not shown). In some embodiments, the weight of the patient 3 on the inflatable bladder portion 16*a* assists in deflation.

At step 116, a second inflatable bladder portion 16*b* is inflated to rotate a second portion of the patient 3 to a predetermined rotational angle 46. The inflatable bladder portion 16*b* is inflated by coupling an air supply hose of an inflation device to an inlet 4 coupled to an air flow path 7 of the inflatable bladder portion 16*b*. Air flow is provided to the internal cavity 10 defined by the inflatable bladder portion 16*b*, which inflates the inflatable bladder portion 16*b* to the predetermined rotational angle 46. Inflation of the inflatable bladder portion 16*b* rotates the patient 3 (or the second portion of the patient 3) to the predetermined rotational angle 46.

FIGS. 8-12 illustrate an embodiment of an inflatable transfer mattress 1*a* including a four-layer construction, in accordance with some embodiments. The inflatable transfer mattress 1*a* is similar to the inflatable transfer mattress 1 discussed in conjunction with FIGS. 1-6, and similar description is not repeated herein. In some embodiments, an inflatable bladder 216 is defined by a top bladder layer 22 coupled directly to a top layer 18 of the inflatable transfer mattress 1*a* such that the top layer 18 of the inflatable transfer mattress 1*a* defines the bottom surface of the inflatable bladder 16. The top bladder layer 22 and the top mattress layer 18 define an internal cavity 10*a* therebetween. When air is provided to the internal cavity 10*a*, for example, by an air supply coupled to a valve 4, the top bladder layer 22 is expanded away from the top mattress layer 18 such that the inflatable transfer mattress 1*a* maintains a consistent shape when a bladder portion 216*a* is inflated.

In some embodiments, the top layer 18 of the inflatable transfer mattress 1*a* further defines a portion of a distal air inlet path 207. A cut and/or other surface feature may be formed in the top layer 18 to facilitate welding of the top bladder layer 22 to the top mattress layer 18. In some embodiments, each of the top bladder layer 22 and the top mattress layer 18 include additional material that extends beyond a distal edge 52 of the inflatable transfer mattress 1*a* to allow access to the valves 4 even when a patient is positioned on the inflatable transfer mattress 1*a*.

Figure 8:
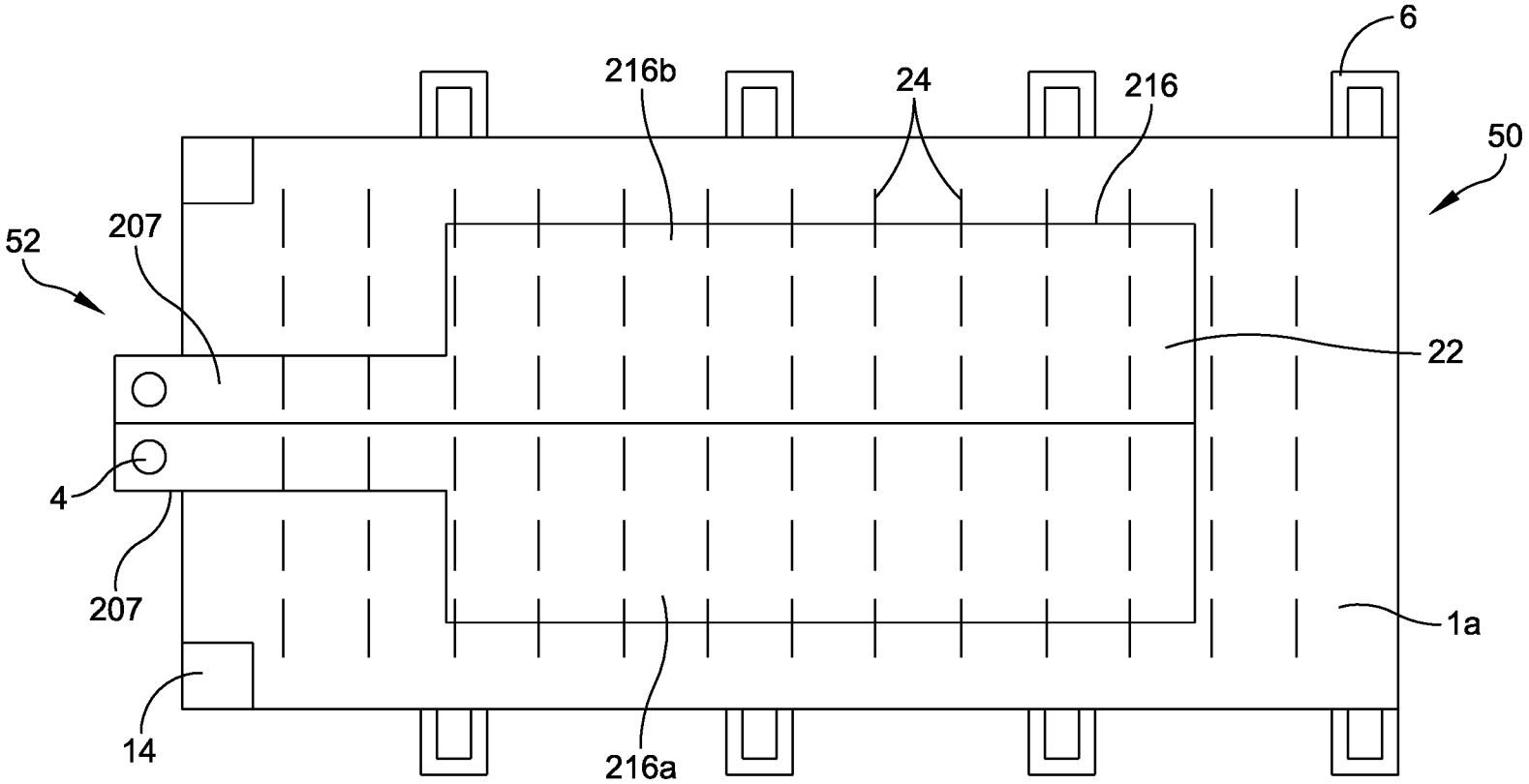
FIG. 8 illustrates a top view of a patient transfer device including a four-layer construction and a plurality of distal flow paths, in accordance with some embodiments.
Figure 9:
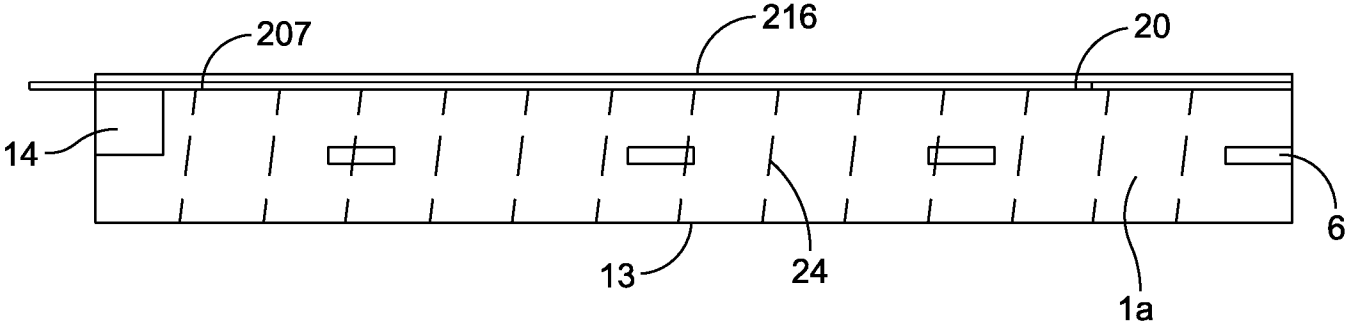
FIG. 9 illustrates a side view of the patient transfer device of FIG. 8, in accordance with some embodiments.
Figure 10:
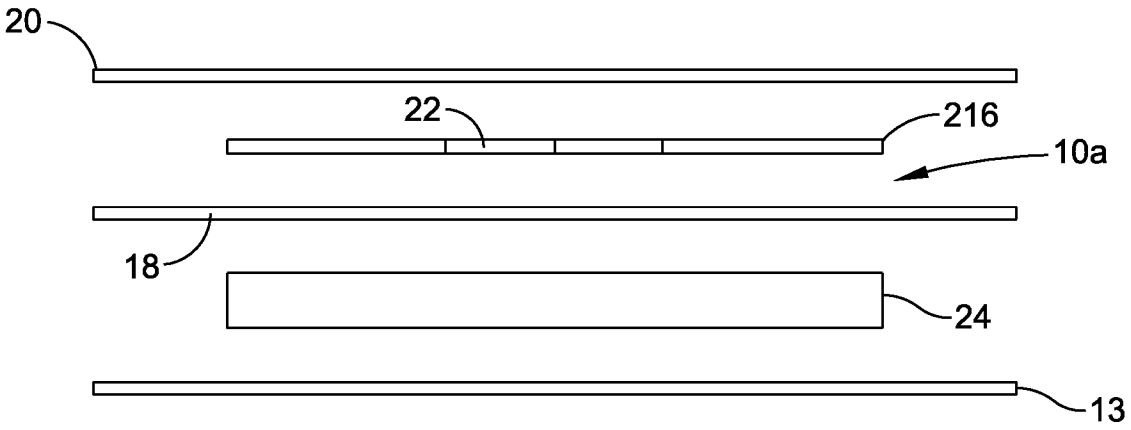
FIG. 10 illustrates a side exploded view of the patient transfer device of FIG. 8, in accordance with some embodiments.
Figure 11:
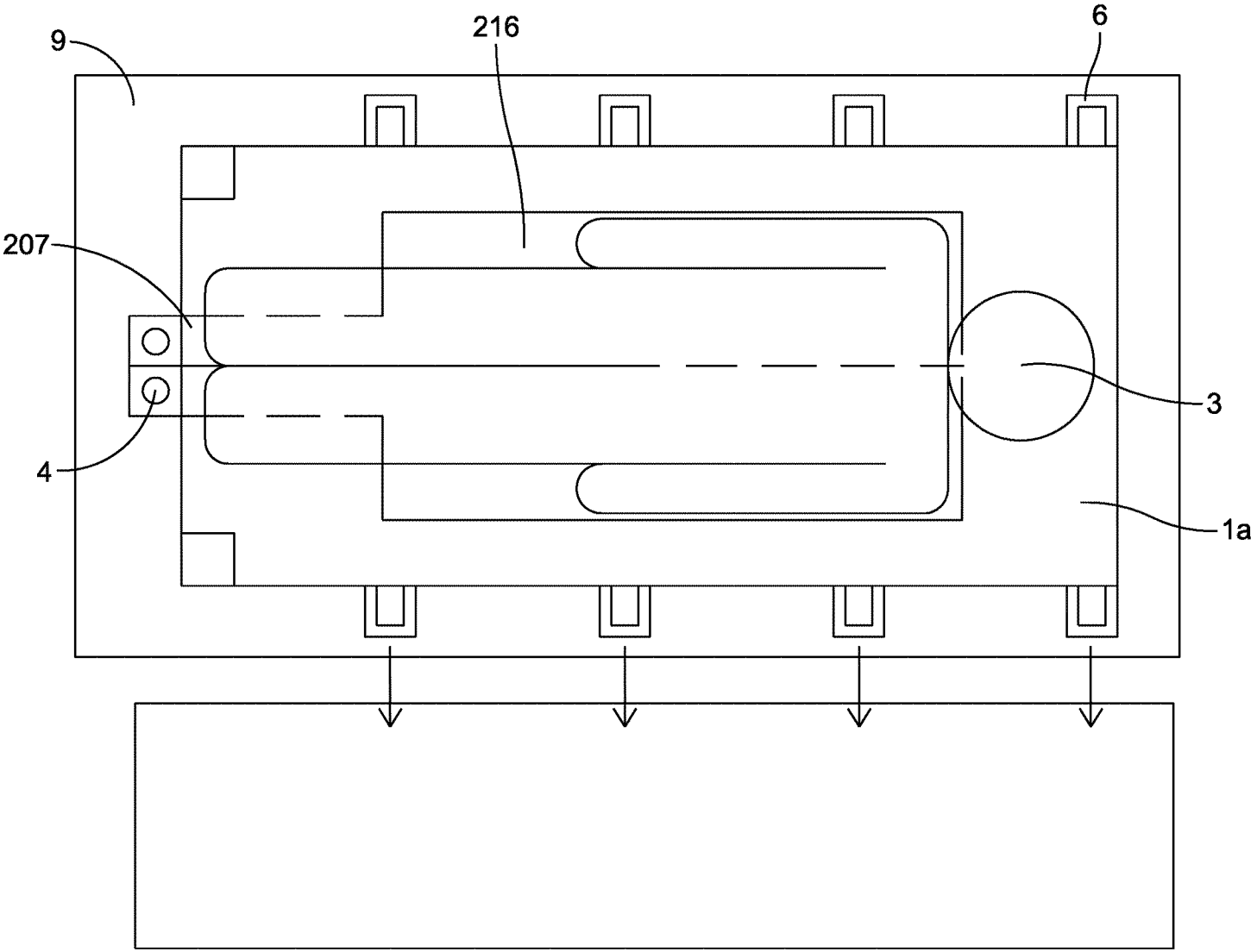
FIG. 11 illustrates a top view of the patient transfer device of FIG. 8 having a patient positioned thereon, in accordance with some embodiments.
Figure 12:
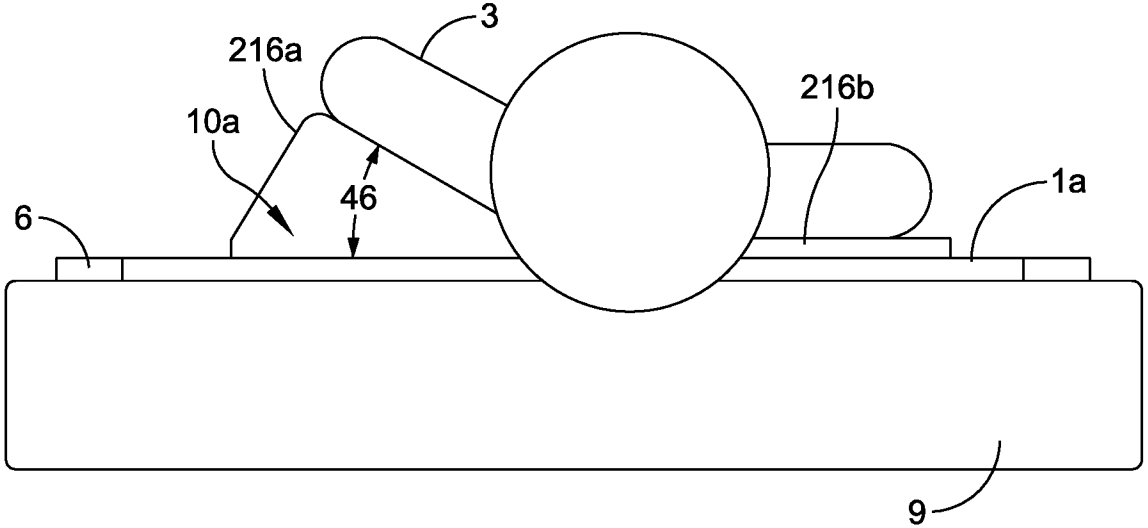
FIG. 12 illustrates a front view of the patient transfer device of FIG. 11 having a first bladder portion in an inflated state, in accordance with some embodiments.
Figure 13:
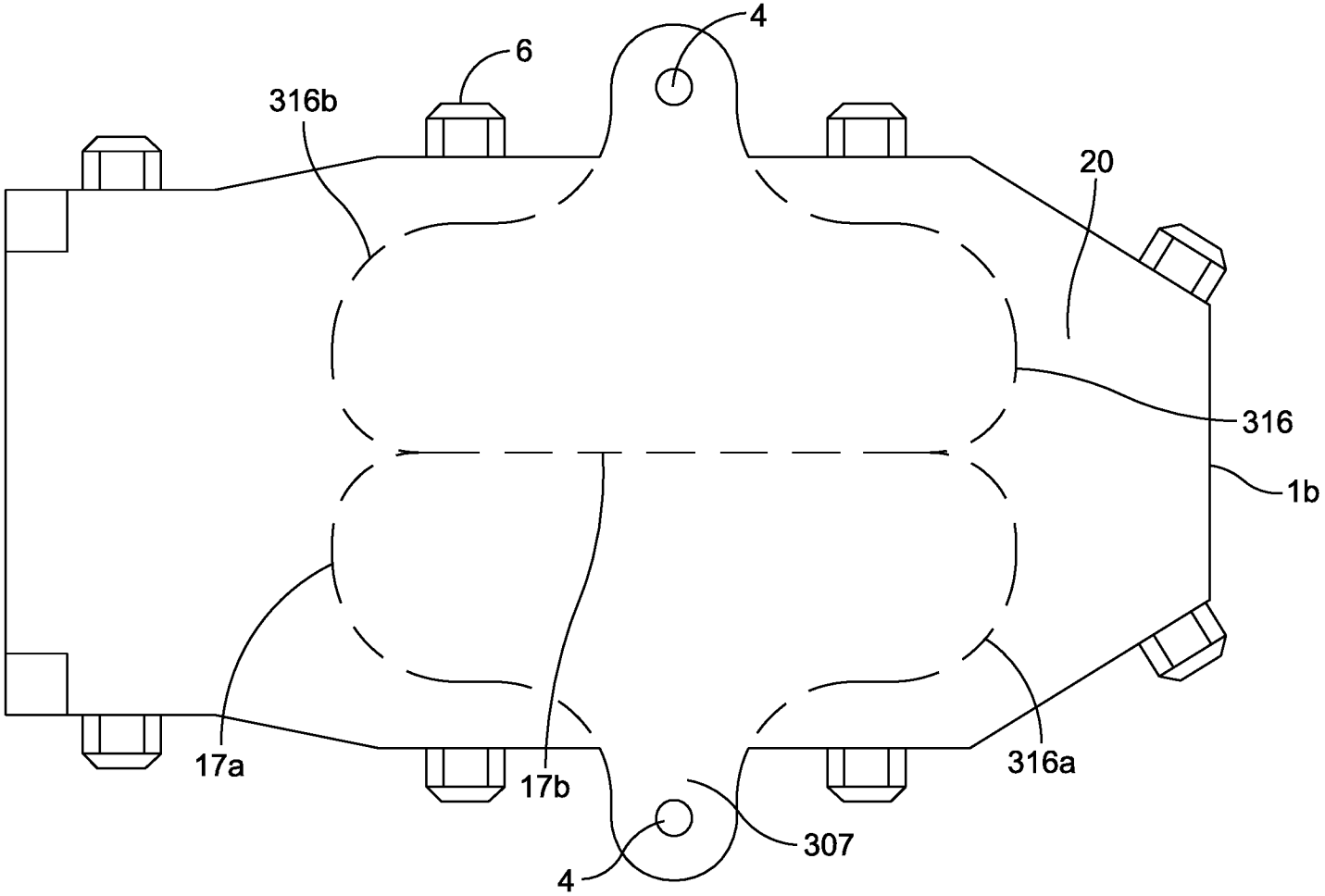
FIG. 13 illustrates a top view of a patient transfer device including a log-rolling style bladder and a non-woven patient contact layer formed integrally therewith, in accordance with some embodiments.

For example, as shown in FIG. 8, in some embodiments, each of the bladder portions 216*a*, 216*b* include a distal air inlet path 207 extending from the bladder portion 216*a*, 216*b* towards and beyond a distal (or foot) edge 52 of the inflatable transfer mattress 1*a*. The valve 4 associated with each of the inflatable bladder portions 216*a*, 216*b* is positioned at a distal end of each of the air inlet paths 207 and is configured to be coupled to an air hose of the air supply system. Operation of the inflatable transfer mattress 1*a* is similar to operation of the inflatable transfer mattress 1 described above, and similar description is not repeated herein.

In some embodiments, the inflatable transfer mattress 1*a* includes a patient contact layer 20 positioned above the top bladder layer 22 and the top mattress layer 18. For example, in various embodiments, the patient contact layer can include any suitable patient contact layer, such as, for example, a sheet of fabric, e.g., nylon scrim or the like, and may be coated on at least an outer surface with a water proof coating, fibers/fabrics suitable for a single use panel, an aliphatic polyester, and/or any other suitable patient contact surface. The patient contact layer 20 can be sealingly fastened to the top layer 18 of the inflatable transfer mattress 1*a*, for example, by a continuous weld formed integrally with the sealing weld formed between the top panel 18 and the bottom panel 13, although it will be appreciated that any suitable coupling mechanism can be used.

Figure 14:
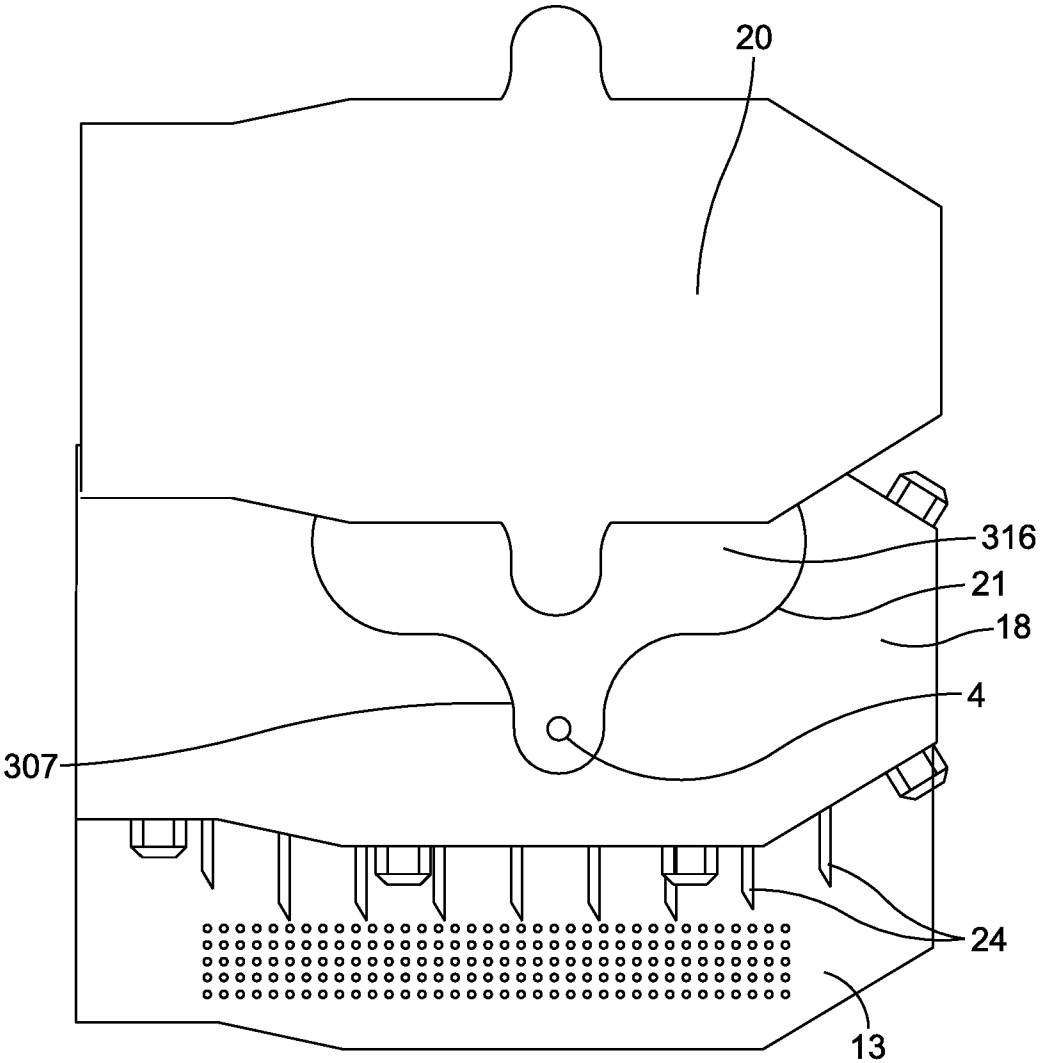
FIG. 14 illustrates an exploded view of the patient transfer device of FIG. 13, in accordance with some embodiments.

FIGS. 13-17 illustrate an embodiment of an inflatable transfer mattress 1*b* including bladder portions 316*a*, 316*b* formed integrally with a patient contact layer 20, in accordance with some embodiments. The inflatable transfer mattress 1*b* is similar to the inflatable transfer mattresses 1, 1*a* described above, and similar description is not repeated herein. The inflatable transfer mattress 1*b* includes a plurality of bladder portions 316*a*, 316*b* having oval or semi-oval cross-sections. As shown in FIG. 14, a bladder 316 is coupled between a top mattress layer 18 and a non-woven patient contact layer 20 of the inflatable transfer mattress 1*b*. The bladder 316 includes a center weld 17*b* formed at a mid-point to define a first bladder portion 316*a* and a second style bladder portion 316*b*.

Figure 15:
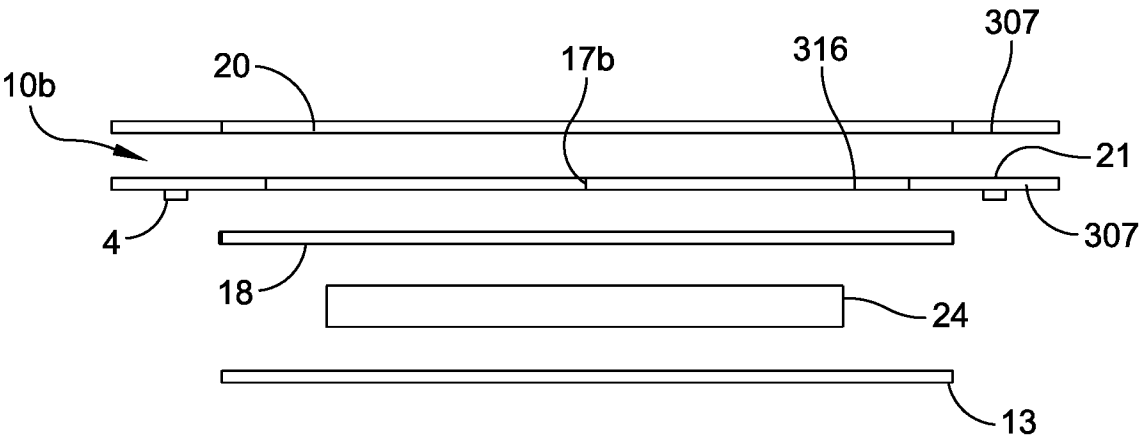
FIG. 15 illustrates a side exploded view of the patient transfer device of FIG. 13, in accordance with some embodiments.
Figure 16:
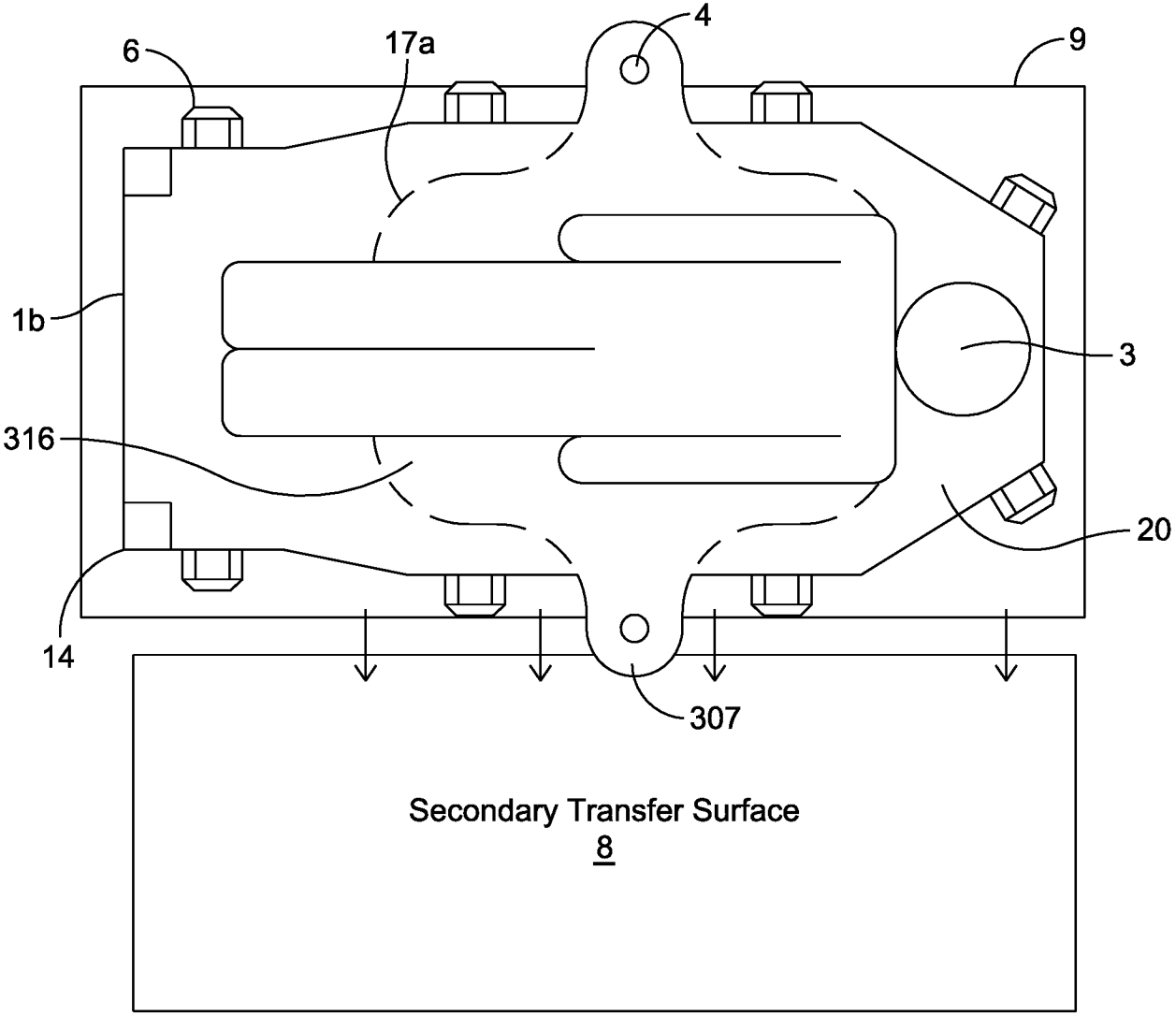
FIG. 16 illustrates a top view of the patient transfer device of FIG. 13 having a patient positioned thereon, in accordance with some embodiments.
Figure 17:
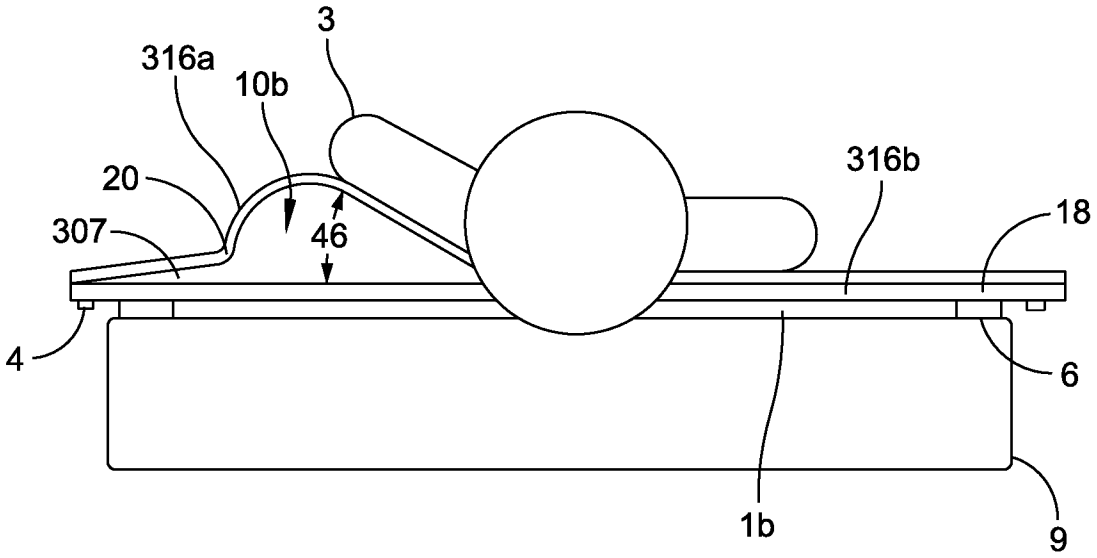
FIG. 17 illustrates a front view of the patient transfer device of FIG. 16, in accordance with some embodiments.

As shown in FIGS. 14-15, in some embodiments, the inflatable transfer mattress 1*b* includes a non-woven patient contact layer 20 formed integrally over the top mattress layer 18 and the top bladder layer 22. The non-woven patient contact layer 20 can include any suitable patient contact layer, such as, for example, a sheet of fabric, e.g., nylon scrim or the like, and may be coated on at least an outer surface with a water proof coating, fibers/fabrics suitable for a single use panel, an aliphatic polyester, and/or any other suitable patient contact surface. The non-woven patient contact layer 20 can be sealingly fastened to the top layer 18 of the inflatable transfer mattress 1*b*, for example, by a continuous weld formed integrally with the sealing weld formed between the top panel 18 and the bottom panel 13, although it will be appreciated that any suitable coupling mechanism can be used.

In some embodiments, the inflatable bladder 316 is is defined by a bottom bladder layer 21 coupled directly to a non-woven patient contact layer 20 such that the non-woven patient contact layer 20 defines the top surface of the inflatable bladder 316. The bottom bladder layer 21 and the non-woven patient contact layer 20 define an internal cavity 10*b* therebetween. When air is provided to the internal cavity 10*b*, for example, by an air supply coupled to a valve 4, a portion of the non-woven patient contact layer 20 is expanded away from the top mattress layer 18 such that the inflatable transfer mattress 1*b* maintains a consistent shape when a bladder portion 316*a* is inflated.

In some embodiments, the non-woven patient contact layer 20 further defines a portion of an air inlet path 307. A cut and/or other surface feature may be formed in the non-woven patient contact layer 20 to facilitate welding of the bottom bladder layer 21 to the non-woven patient contact layer 20. In some embodiments, each of the bottom bladder layer 21 and the non-woven patient contact layer 20 include additional material that extends beyond a distal edge 52 of the inflatable transfer mattress 1*b* to allow access to the valves 4 even when a patient is positioned on the inflatable transfer mattress 1*b*.

FIGS. 18-22 illustrate an embodiment of an inflatable transfer mattress 1*c* having a plurality of inflatable pontoons 25*a*-25*d* formed integrally therewith, in accordance with some embodiments. The inflatable transfer mattress 1*c* is similar to the inflatable transfer mattresses 1, 1*a*, 1*b* described in conjunction with FIGS. 1-17, and similar description is not repeated herein. The inflatable transfer mattress 1*c* includes a plurality of individually inflatable pontoons 25*a*-25*d* positioned between a top layer 18 and a bottom layer 13 of the inflatable transfer mattress 1*c* (i.e., within the internal cavity defined by the top layer 18 and the bottom layer 13). Each of the inflatable pontoons 25*a*-25*d* includes a continuous cylinder of material defining an internal volume 10*b* configured to receive an air flow therein. In some embodiments, two or more of the inflatable pontoons 25*a*-25*d* are in fluid communication such that air flow into one of the inflatable pontoons, for example the first inflatable pontoon 25*a*, flows into a second of the inflatable pontoons, for example the second inflatable pontoon 25*b*. The connected inflatable pontoons 25*a*-25*d* are simultaneously and/or serially inflated by the air flow.

Figure 18:
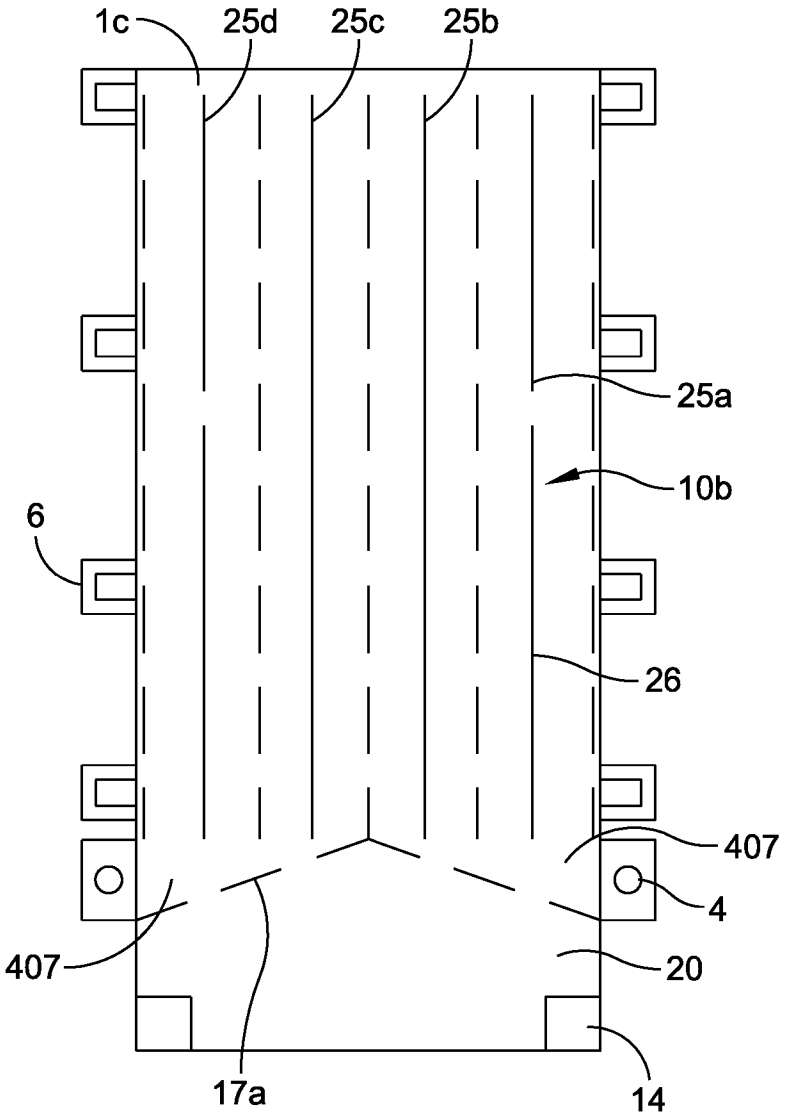
FIG. 18 illustrates top view of a patient transfer device including a plurality of individually inflatable pontoons, in accordance with some embodiments.
Figure 19:
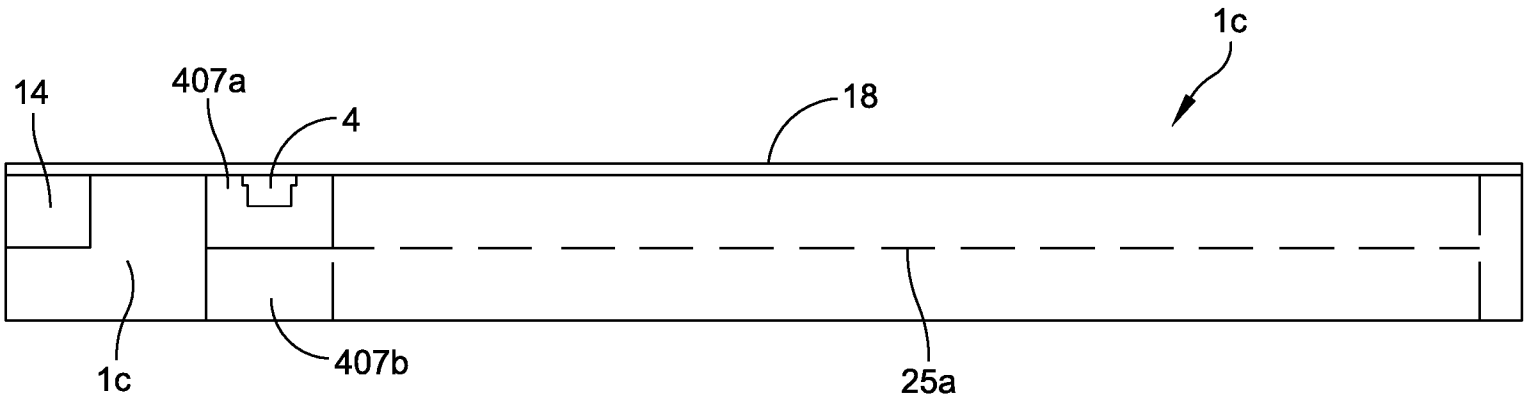
FIG. 19 illustrates a side view of the patient transfer device of FIG. 18, in accordance with some embodiments.

In some embodiments, each set of connected inflatable pontoons (e.g., a first set including a first and second inflatable pontoon 25*a*, 25*b*, a second set including a third and fourth inflatable pontoon 25*c*, 25*d*, etc.), has an air flow path 407 defining a first flow portion 407*a* and a second flow portion 407*b*, as shown in FIG. 18. Air flow from the valve 4 is provided to each of the flow portions 407*a*, 407*b* to simultaneously and/or serially (e.g., sequentially) inflate aset of inflatable pontoons 25*a*-25*d*. In some embodiments, the valve 4 is a two-way valve that allows deflation of the set of inflatable pontoons 25*a*-25*d* after inflation. In some embodiments, one or more deflation valves (not shown) can be coupled to the air flow portions 407*a*, 407*b* and/or to individual inflatable pontoons 25*a*-25*d* to allow deflation.

In some embodiments, the inflatable pontoons 25*a*-25*b* act as stringers (or other support structures) when in a deflated state. For example, when the inflatable transfer mattress 1*c* is transitioned from a deflated state to an inflated state by coupling an air supply hose to the inlet 14, the deflated inflatable pontoons 25*a*-25*d* prevent ballooning and/or deformation of the inflatable transfer mattress 1*c* during inflation and subsequent transfer procedures. The inflatable pontoons 25*a*-25*d* can be coupled to the top layer 18 and/or the bottom layer 13 of the mattress at one or more points and/or may be coupled to adjacent inflatable pontoons 25*a*-25*d*. The connection points are selected such that the inflatable pontoons 25*a*-25*d* prevent ballooning of the inflatable transfer mattress 1*c* during inflation and return to a flat configuration when the inflatable transfer mattress 1*c* is deflated to prevent patient discomfort.

Figure 20:
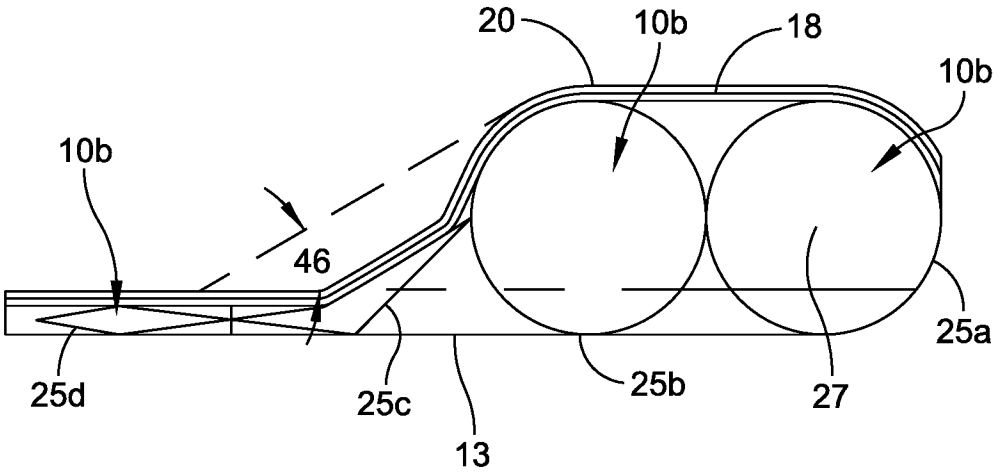
FIG. 20 illustrates a cross-sectional view of the patient transfer device of FIG. 18 taken along line A-A and having a first and second inflatable pontoon in an inflated state, in accordance with some embodiments.
Figure 21:
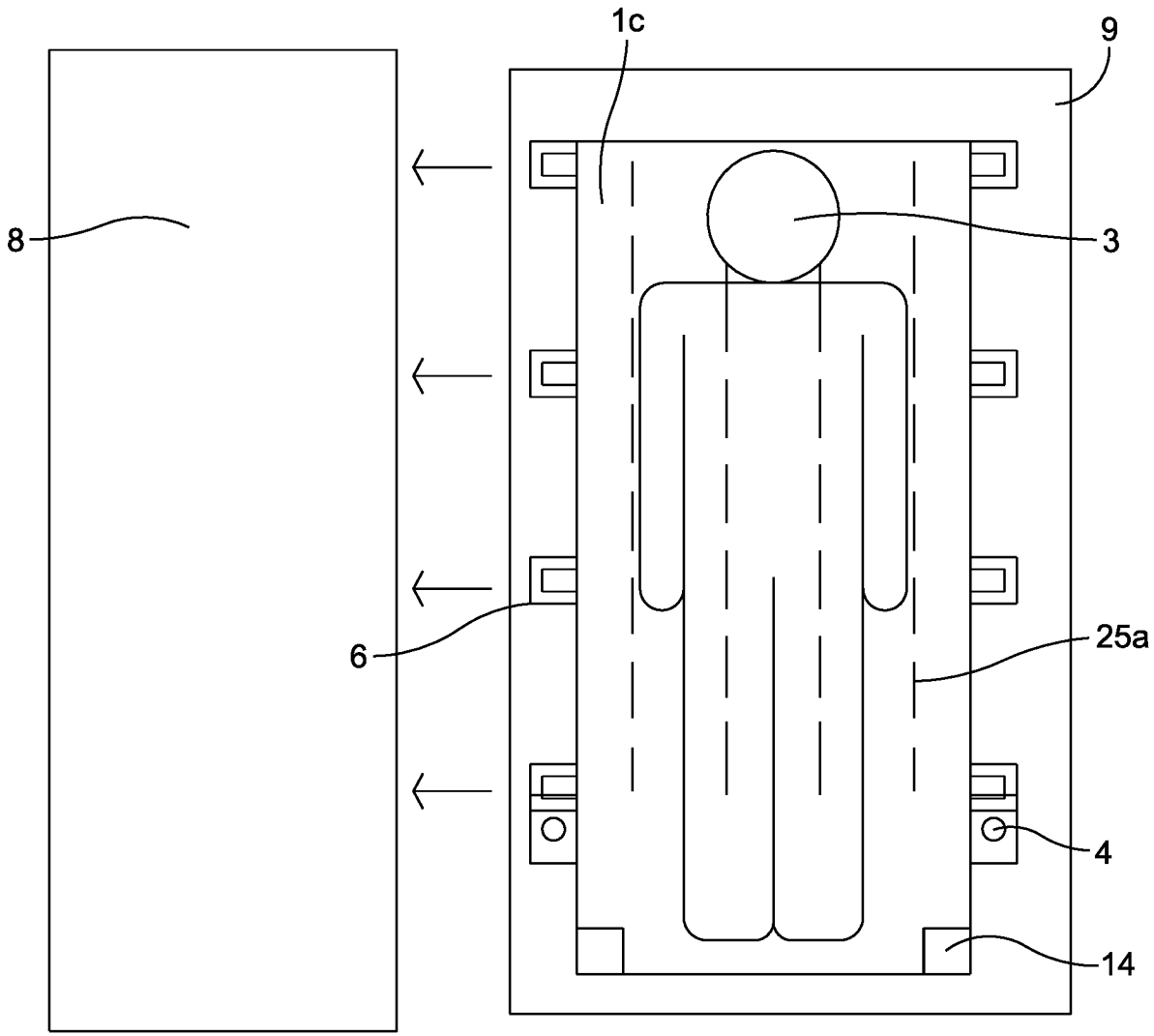
FIG. 21 illustrates a top view of the patient transfer device of FIG. 18 including a patient positioned thereon, in accordance with some embodiments.
Figure 22:
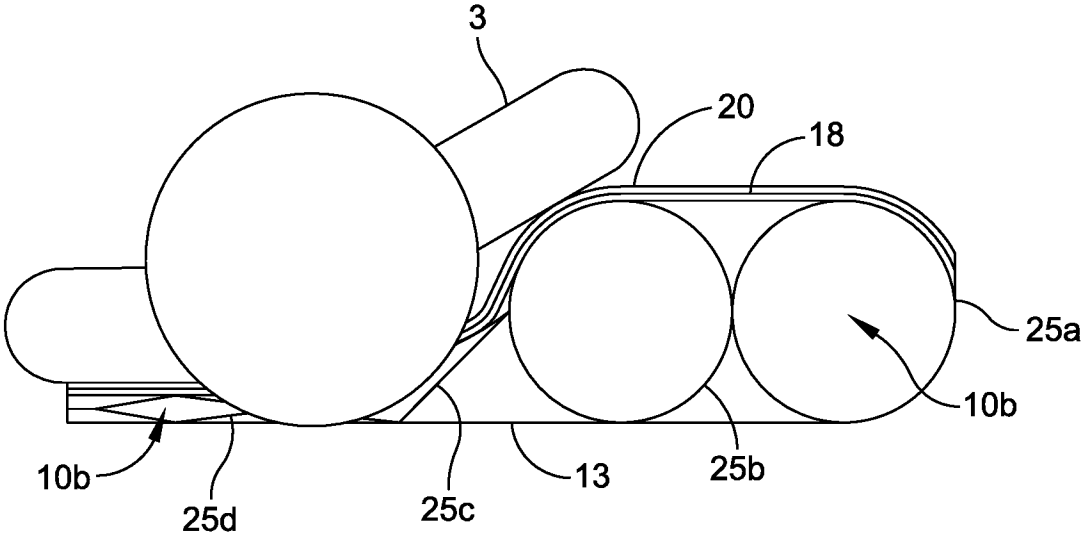
FIG. 22 illustrates a cross-sectional view of the patient transfer device of FIG. 21 taken along line A-A and having a first and second inflatable pontoon in an inflated state, in accordance with some embodiments.

Operation of the inflatable transfer mattress 1*c* is similar to operation of the inflatable transfer mattress 1 described above. As shown in FIG. 20, to transfer a patient, an air flow source is coupled to the inflation valve 14 to provide air flow into the internal cavity defined between the top mattress layer 18 and the bottom mattress layer 13. Air flows from the internal cavity through a plurality of holes 36 formed in the bottom mattress layer 13 to provide lubrication during transfer and deflation after transfer. As shown in FIG. 21, to rotate a patient, a first set of inflatable pontoons 25*a*, 25*b* are inflated to rotate the patient 3 (and/or a portion of the patient 3) to a predetermined rotational angle. As discussed above, the predetermined rotational angle can include any suitable angle configured to alleviate pressure on one or more sections of the patient 3, such as, for example, the sacrum.

In some embodiments, the inflatable pontoons 25*a*-25*d* are configured to provide log-rolling, or lateral movement, of a patient 3 during rotation. For example, in some embodiments, the inflatable pontoons 25*a*-25*d* are configured to simultanesouly and/or sequentially inflate such that the patient 3 is move in a slight lateral direction while maintaining a position on top of the inflatable transfer mattress 1*c*. Such lateral movement may further assist in alleviating pressure and/or contact issues between the patient 3 and the surfaces 8, 9. The inflatable pontoons 25*a*-25*d* may be deflated to move the patient 3 back to a center or starting position and/or a second set of inflatable pontoons 25*a*-25*d* may be inflated to move the patient 3 in an opposite lateral direction. In other embodiments, the inflatable pontoons 25*a*-25*d* are configured to inflate such that the patient 3 remains in a substantially centered position on the inflatable transfer mattress 1*c* during inflation and/or deflation.

Although the subject matter has been described in terms of exemplary embodiments, it is not limited thereto. Rather, the appended claims should be construed broadly, to include other variants and embodiments, which may be made by those skilled in the art.

What is claimed is:

1. An inflatable transfer mattress, comprising:

a top panel;

a bottom panel having a perimeter sealingly coupled to a perimeter of the top panel to define an internal volume therebetween, wherein the internal volume is configured to receive a first air flow therein, wherein the first air flow is configured to inflate the internal volume to support a patient in contact with the top panel; and a plurality of inflatable pontoons positioned within the internal volume, wherein each of the plurality of inflatable pontoons is configured to be transitioned from a deflated state in which each of the plurality of inflatable pontoons are flat to an inflated state in which each of the plurality of inflatable pontoons define a cylindrical cross-section, wherein each of the plurality of inflatable pontoons is fluidically isolated from the internal volume, wherein at least one of the plurality of inflatable pontoons is configured to receive a second air flow configured to inflate at least one of the plurality of inflatable pontoons, and wherein each of the plurality of inflatable pontoons is configured to act as a stringer when in a deflated state.

2. The inflatable transfer mattress of claim 1, wherein the plurality of inflatable pontoons comprises a first set of inflatable pontoons positioned on a first side of a centerline of the top panel and a second set of inflatable pontoons positioned on a second side of the centerline.

3. The inflatable transfer mattress of claim 2, wherein each inflatable pontoon in the first set of inflatable pontoons is in fluid communication and each inflatable pontoon in the second set of inflatable pontoons is in fluid communication.

4. The inflatable transfer mattress of claim 2, wherein each inflatable pontoon in the first set of inflatable pontoons is coupled to a first air flow path having a proximal end coupled to at least one of the plurality of inflatable pontoons in the first set of inflatable pontoons and a distal end, wherein each inflatable pontoon in the second set of inflatable pontoons is coupled to a second air flow path having a proximal end coupled to at least one of the plurality of inflatable pontoons in the second set of inflatable pontoons and a distal end, wherein the distal end of each of the first air flow path and the second air flow path is configured to extend beyond the perimeter of the bottom panel.

5. The inflatable transfer mattress of claim 4, comprising a first valve formed integrally with the first air flow path adjacent the distal end.

6. The inflatable transfer mattress of claim 1, wherein each of the plurality of inflatable pontoons is coupled to the top panel along a first line and the bottom panel along a second line.

7. The inflatable transfer mattress of claim 1, wherein each of the plurality of inflatable pontoons is coupled to an adjacent one of the plurality inflatable pontoons.

8. The inflatable transfer mattress of claim 1, wherein the bottom panel defines a plurality of holes configured to provide air flow from the internal volume to an area located between the bottom panel and a surface.

9. The inflatable transfer mattress of claim 1, wherein inflation of at least one of the plurality of inflatable pontoons is configured to rotate a patient to a predetermined rotational angle with respect to the top panel.

10. The inflatable transfer mattress of claim 9, wherein the predetermined angle is an angle in a range of 0-30 degrees.

11. The inflatable transfer mattress of claim 1, comprising a non-woven patient contact layer positioned over the top panel, wherein the non-woven patient contact layer is coupled to the top panel.

12. An inflatable transfer mattress, comprising:

a top panel;

a bottom panel having a perimeter sealingly coupled to a perimeter of the top panel to define an internal volume therebetween, wherein the internal volume is configured to receive a first air flow therein, wherein the first air flow is configured to inflate the internal volume to support a patient in contact with the top panel; and a plurality of inflatable pontoons positioned within the internal volume, wherein each of the plurality of inflatable pontoons is configured to be transitioned from a deflated state in which each of the plurality of inflatable pontoons are flat to an inflated state in which each of the plurality of inflatable pontoons define a cylindrical cross-section by a second air flow, wherein each of the plurality of inflatable pontoons is coupled to the top panel along a first line and the bottom panel along a second line, and wherein each of the plurality of inflatable pontoons is coupled to an adjacent one of the plurality inflatable pontoons, and wherein each of the plurality of inflatable pontoons is fluidically isolated from the internal volume, and wherein each of the plurality of inflatable pontoons is configured to act as a stringer when in a deflated state.

13. The inflatable transfer mattress of claim 12, wherein the plurality of inflatable pontoons comprises a first set of inflatable pontoons positioned on a first side of a centerline of the top panel and a second set of inflatable pontoons positioned on a second side of the centerline.

14. The inflatable transfer mattress of claim 13, wherein each inflatable pontoon in the first set of inflatable pontoons is in fluid communication and each inflatable pontoon in the second set of inflatable pontoons is in fluid communication.

15. The inflatable transfer mattress of claim 13, wherein each set of inflatable pontoons is coupled to an air flow path having a proximal end coupled to at least one of the plurality of inflatable pontoons in the set of inflatable pontoons and a distal end, wherein the distal end is configured to extend beyond the perimeter of the bottom panel.

16. The inflatable transfer mattress of claim 12, wherein inflation of at least one of the plurality of inflatable pontoons is configured to rotate a patient to a predetermined rotational angle with respect to the top panel.

17. A method of positioning a patient, comprising:

positioning an inflatable transfer mattress on a first surface, the inflatable transfer mattress comprising a top panel, a bottom panel having a perimeter sealingly coupled to a perimeter of the top panel to define an internal volume therebetween, wherein the internal volume is configured to receive a first air flow configured to inflate the internal volume to support a patient in contact with the top panel, and a plurality of inflatable pontoons positioned within the internal volume, wherein each of the plurality of inflatable pontoons is configured to be transitioned from a deflated state in which each of the plurality of inflatable pontoons are flat to an inflated state in which each of the plurality of inflatable pontoons define a cylindrical cross-section, and wherein each of the plurality of inflatable pontoons is fluidically isolated from the internal volume, wherein at least one of the plurality of inflatable pontoons is configured to receive a second air flow configured to inflate at least one of the plurality of inflatable pontoons, and wherein each of the plurality of inflatable pontoons is configured to act as a stringer when in a deflated state;

positioning a patient on the inflatable transfer mattress; and inflating a first set of the plurality of inflatable pontoons to rotate the patient to a first predetermined rotational angle with respect to the top panel of the inflatable transfer mattress, wherein the first set of the plurality of inflatable pontoons is inflated by an air supply coupled to a valve formed integrally with an air flow path of the first set of the plurality of inflatable pontoons.

18. The method of claim 17, comprising:

deflating the first set of the plurality of inflatable pontoons to return the patient to an initial position; and inflating a second set of the plurality of inflatable pontoons to rotate the patient to a second predetermined rotational angle with respect to the top panel of the inflatable transfer mattress.

19. The method of claim 17, comprising:

providing the first air flow to the internal volume defined between the top panel and the bottom panel to inflate the inflatable transfer mattress, wherein the bottom panel defines a plurality of holes sized and configured to provide air flow to a volume positioned between the bottom panel and the first surface; and sliding the inflatable transfer mattress from the first surface to a second surface, wherein the air flow to the volume positioned between the bottom panel and the first surface reduces friction between the inflatable transfer mattress, the first surface, and the second surface.

* * * * *